US010492538B2

(12) United States Patent
Song et al.

(10) Patent No.: US 10,492,538 B2
(45) Date of Patent: Dec. 3, 2019

(54) AEROSOL GENERATOR AND AEROSOL INHALING DEVICE

(71) Applicant: Shenzhen First Union Technology Co., Ltd., Shenzhen, Guangdong Province (CN)

(72) Inventors: Shengjia Song, Shenzhen (CN); Yonghai Li, Shenzhen (CN); Zhongli Xu, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 112 days.

(21) Appl. No.: 15/859,397

(22) Filed: Dec. 30, 2017

(65) Prior Publication Data

US 2018/0184716 A1 Jul. 5, 2018

(30) Foreign Application Priority Data

Dec. 30, 2016 (CN) ..... 2016 2 1475770 U

(51) Int. Cl.
*A24F 47/00* (2006.01)
*A24F 7/02* (2006.01)
*H05B 6/10* (2006.01)

(52) U.S. Cl.
CPC ..... *A24F 47/008* (2013.01); *A24F 7/02* (2013.01); *H05B 6/10* (2013.01)

(58) Field of Classification Search
None
See application file for complete search history.

(56) References Cited

U.S. PATENT DOCUMENTS 5,067,500 A * 11/1991 Keritsis ..... A24B 15/165 128/200.19
2014/0060556 A1 3/2014 Liu
2014/0261488 A1* 9/2014 Tucker ..... A24F 47/008 131/328
2015/0047662 A1* 2/2015 Hopps ..... A24F 47/008 131/329
2016/0089508 A1 3/2016 Smith et al.
(Continued)

FOREIGN PATENT DOCUMENTS

CN 104 095 295 A 10/2014
EP 3 108 918 A1 12/2016
WO 2015/150699 A1 10/2015

*Primary Examiner* — Dennis R Cordray
(74) *Attorney, Agent, or Firm* — PROI Intellectual Property US

(57) ABSTRACT

The present disclosure provides an aerosol generator and an aerosol inhaling device which are capable of regulating easily the flavor of an aerosol inhaled by a user. The aerosol generator includes two chambers configured for generating an aerosol, an air outlet passage, a first branch and a second branch. The two chambers both define an air inlet and an air outlet. The first branch and the second branch are in communication with one of the two air outlets respectively. Airflows in the first and second branches are converged in the air outlet passage before being expelled. At least one of the first and second branches has provided thereon a regulating switch configured for regulating a rate of an airflow passing through the branch, the regulating switch being capable of rotating around a shaft under an external force to control an airflow passing through the first branch or second branch.

10 Claims, 4 Drawing Sheets

(56) References Cited

U.S. PATENT DOCUMENTS

| | | | | |
|---|---|---|---|---|
| 2016/0353800 | A1 | 12/2016 | Di Carlo | |
| 2018/0235280 | A1* | 8/2018 | Biel | A24F 47/008 |
| 2018/0242641 | A1* | 8/2018 | Chaves | A24F 47/008 |
| 2018/0325176 | A1* | 11/2018 | Burseg | A24F 47/008 |

* cited by examiner

AEROSOL GENERATOR AND AEROSOL INHALING DEVICE

CROSS REFERENCE TO RELATED APPLICATIONS

The present application claims priority to Chinese Patent Application CN201621475770.2 filed on Dec. 30, 2016.

TECHNICAL FIELD

The present disclosure relates to the field of smoking sets, and particularly, to an aerosol generator and an aerosol inhaling device including the same aerosol generator.

BACKGROUND

Tobacco smoking not only harms the health of smokers, but also pollutes the surrounding environment. In order to reduce the harm to smokers and reduce the pollution to environment, people have developed an inhaling device which heats tobacco to generate an aerosol through a non-burning manner in the prior art. Compared with conventional cigarettes, the inhaling device heats and bakes solid tobacco substances at a relatively low temperature, which can greatly reduce the harmful substances (for example, tar) inhaled by users; therefore, this kind of inhaling device is gradually welcomed by smokers. This kind of inhaling device also can be used for heating solid aerosol-generating substances such as solid Chinese herbal medicine so as to obtain effective ingredients in the substances.

The inhaling device available on the current market generally has one heating chamber only, and the user can obtain only one aerosol flavor too.

SUMMARY

In view of the drawbacks in the prior art, the technical problem to be solved by the present disclosure is providing an aerosol generator and an aerosol inhaling device which are capable of regulating easily the flavor of an aerosol inhaled by a user.

In order to realize the above purpose of the present disclosure, the present disclosure employs an aerosol generator as follows. The aerosol generator includes two chambers, an air outlet passage, a first branch and a second branch, the two chambers being configured for generating an aerosol and both of the two chambers defining an air inlet and an air outlet, the first branch being in communication with one of the two air outlets, the second branch being in communication with the other of the two air outlets, airflows in the first and second branches being converged in the air outlet passage before being expelled, at least one of the first and second branches having provided thereon a regulating switch, the regulating switch being configured for regulating a rate of an airflow passing through the second branch, and the regulating switch being capable of rotating around a shaft under an external force to control an airflow passing through the first branch or second branch.

Further, at least one of the two air outlets has an air filtering element provided thereon.

Further, the air outlet passage has a radiating fin provided on an outer wall thereof.

Further, at least one of the two chambers adopts an electromagnetic induction heating manner.

Further, at least one of the two chambers adopts a scheme of heating a solid aerosol-generating substance to generate an aerosol.

Further, at least one of the two chambers adopts a scheme of heating a tobacco liquid to generate an aerosol.

Further, the regulating switch has one end extended out of a housing of the aerosol generator for a user to regulate.

Further, the aerosol generator further includes a detachable mouthpiece, in which the air outlet passage, the regulating switch, the first branch and the second branch are disposed; and, after the mouthpiece is detached, the two chambers are exposed for refill of an aerosol-generating substance, and one end of the regulating switch is exposed for a user to regulate the rotation of the regulating switch.

Further, the air outlet passage further includes a mixing chamber, the mixing chamber being defined where the air outlet passage is in connection with the first branch and the second branch.

In order to realize the above purpose of the present disclosure, the present disclosure further employs an aerosol inhaling device. The aerosol inhaling device includes an aerosol generator and a power supply, the power supply being configured for supplying power to the aerosol generator, wherein the aerosol generator is the aerosol generator described in any one of the above aerosol generators.

Compared with the prior art, in the present disclosure both of the aerosol generator and the aerosol inhaling device include two chambers, the two chambers are in communication with the first branch and the second branch respectively, and at least one of the first branch and the second branch has provided thereon the regulating switch configured for regulating a rate of the airflow passing through the branch, thus the converged volume of the air outlet volumes of the two chambers can be regulated through the regulating switch, so that the flavor of the aerosol inhaled by a user can be regulated according to the preference of the user.

Other beneficial effects of the present disclosure will be described in further detail in exemplary embodiments below.

DETAILED DESCRIPTION

The to-be-solved technical problem, the technical scheme and the beneficial effects of the disclosure will become more clearly understood from the detailed description of the present disclosure below taken in conjunction with accompanying drawings and embodiments. It should be understood that the exemplary embodiments described below are merely to illustrate, but to limit, the present disclosure.

Figure 1:
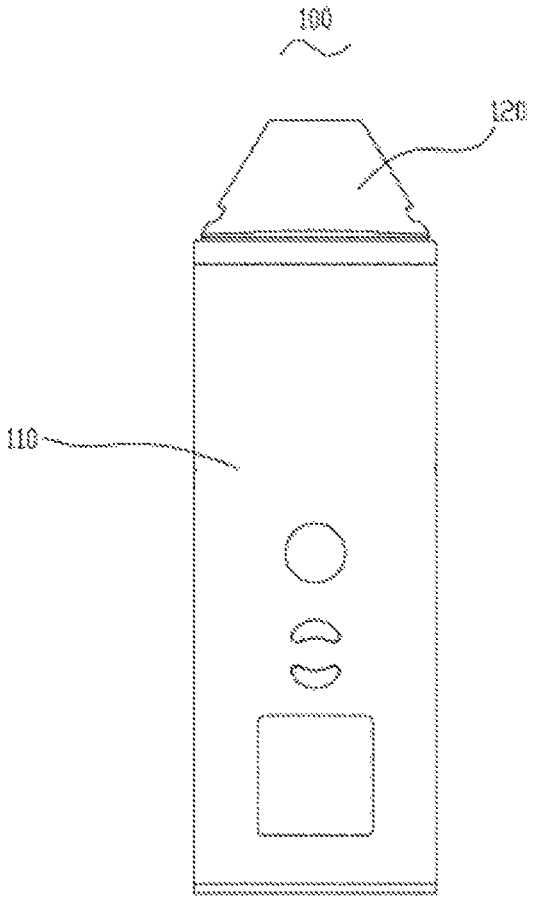
FIG. 1 is a front view of an aerosol inhaling device according to an embodiment.
Figure 2:
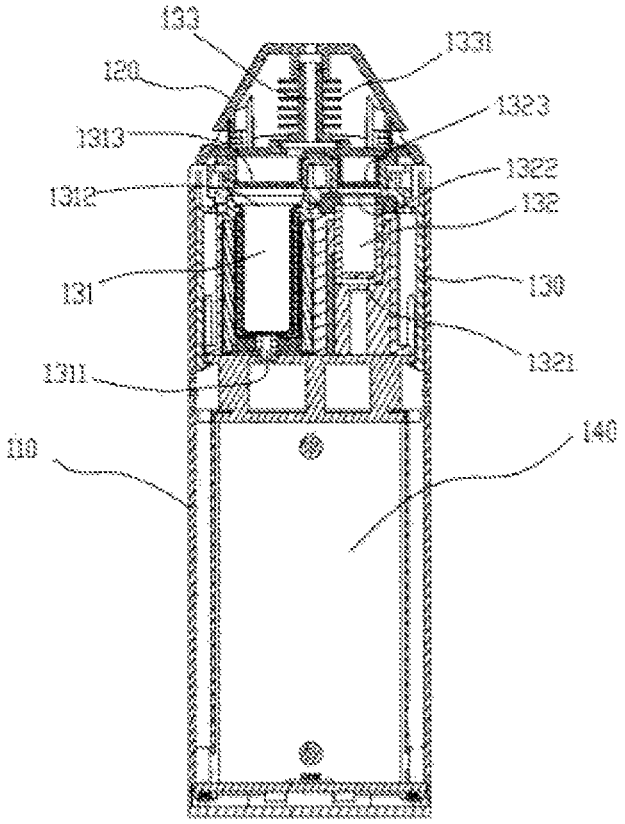
FIG. 2 is a sectional view of an aerosol inhaling device according to an embodiment.

As shown in FIG. 1 and FIG. 2, this embodiment further provides an aerosol inhaling device 100, which is configured for heating an aerosol-generating substance to generate an aerosol. The aerosol inhaling device 100 includes a housing 110 and a mouthpiece 120. The housing 110 has provided therein an aerosol generator 130 and a power supply 140 configured for supplying power to the aerosol generator 130. The mouthpiece 120 is detachably disposed on the aerosol generator 130. Herein, the mouthpiece 120 also can be viewed as one part of the aerosol generator 130.

Figure 3:
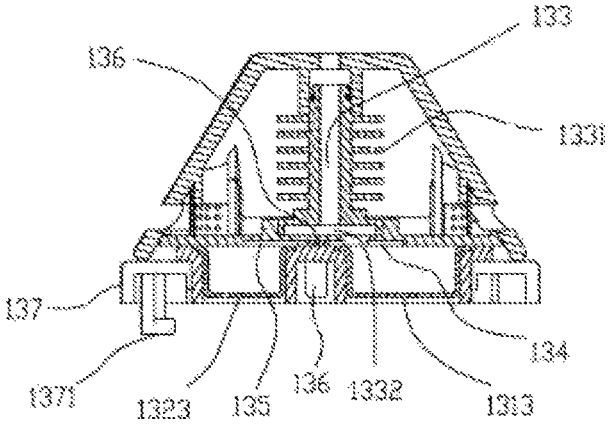
FIG. 3 is a sectional view of a mouthpiece according to an embodiment.

As shown in FIG. 2 and FIG. 3, the aerosol generator 130 includes a first chamber 131 and a second chamber 132, wherein the first chamber 131 defines an air inlet 1311 and an air outlet 1312, and the second chamber 132 defines an air inlet 1321 and an air outlet 1322. The mouthpiece 120 has provided thereon a filtering element 1313, a filtering element 1323, an air outlet passage 133, a first branch 134 and a second branch 135, and the mouthpiece 120 has further provided thereon a connecting piece 137 to be in connection with the aerosol generator 130. The mouthpiece 120 can be snapped on the aerosol generator 130 through a snap-fit structure 1371 on the connecting piece 137, so as to cover the first chamber 131 and the second chamber 132 and to allow the filtering element 1313 to be positioned on the air outlet 1312 and the filtering element 1323 to be positioned on the air outlet 1322. The filtering element 1313 and the filtering element 1323 are configured for preventing large particles in the airflow entering the first branch 134 and the second branch 135. The first branch 134 is in communication with the air outlet 1312, and the second branch 135 is in communication with the air outlet 1322. Airflows in the first branch 134 and second branch 135 are converged in the air outlet passage 133 before being expelled to be inhaled by a user.

Figure 4:
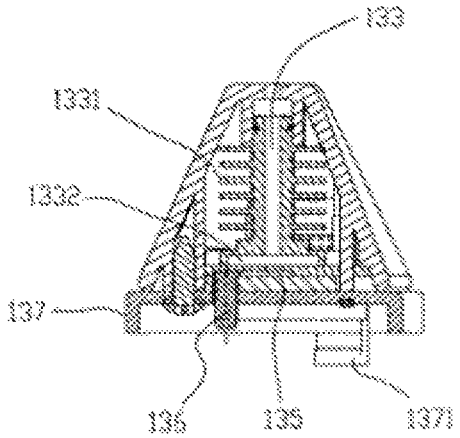
FIG. 4 is a lateral sectional view of a mouthpiece according to an embodiment.
Figure 5:
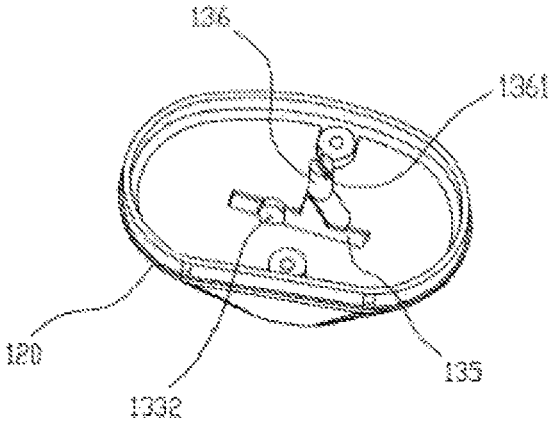
FIG. 5 is a structural perspective view of a mouthpiece having a connection structure removed and a regulating switch exposed.

Again, as shown in FIG. 4 and FIG. 5, the second branch 135 has provided thereon a regulating switch 136 configured for regulating a rate of an airflow passing through the second branch 135, so that the volume of the airflow flowing from the air outlet 1322 to the air outlet passage 133 is controlled. The regulating switch 136 is a blocking structure capable of rotating under an external force, the blocking structure being capable of rotating within a preset track space under an external force, so as to control the airflow passing through the second branch 135.

As shown in FIG. 3 and FIG. 4, in this embodiment, the air outlet passage 133 further includes a mixing chamber 1332, which is defined where the air outlet passage 133 is in connection with the first branch 134 and the second branch 135, that is to say, airflows from the first branch 134 and second branch 135 are mixed in the mixing chamber 1332 before being expelled. The air outlet passage 133 has a radiating fin 1331 provided on an outer wall thereof, the radiating fin 1331 being configured for cooling the airflow in the air outlet passage 133. In other embodiments, the regulating switch 136 can also be disposed on the first branch 134, or an airflow regulating switch is disposed on the first branch 134 simultaneously.

In this embodiment, the first chamber 131 adopts an electromagnetic induction heating manner to heat a solid aerosol-generating substance, and the second chamber 132 adopts a resistance heating manner to heat a perfume or tobacco liquid. The first chamber 131 has a plurality of induction coils disposed at the periphery thereof; the cup defining the first chamber 131 is made from a material capable of inducing an electromagnetic field to generate an eddy current to heat up. When the aerosol generator 130 is used, the mouthpiece 120 is detached from the aerosol generator 130 to expose the first chamber 131 and second chamber 132, so that an aerosol-generating substance can be inserted into the chamber from the air inlet 1311 or air outlet 1312. After the mouthpiece 120 is detached, one end of the regulating switch 136 is exposed for a user to regulate the rotation of the regulating switch. In this embodiment, the regulating switch 136 defines a groove 1361 for a user to regulate using a straight blade device.

In other embodiments, when the solid aerosol-generating substance contains a metal capable of inducing an electromagnetic field to heat up, the cup can be made from a material which is capable of enduring the temperature for heating the solid aerosol-generating substance and incapable of resisting electromagnetic property and generating eddy current. For example, the cup is made of ceramic or glass or glass fiber material.

In this embodiment, the solid aerosol-generating substance is solid tobacco or solid aromatic substance. In other embodiments, the solid aerosol-generating substance can also be tobacco paste or Chinese herbal medicine.

Figure 6:
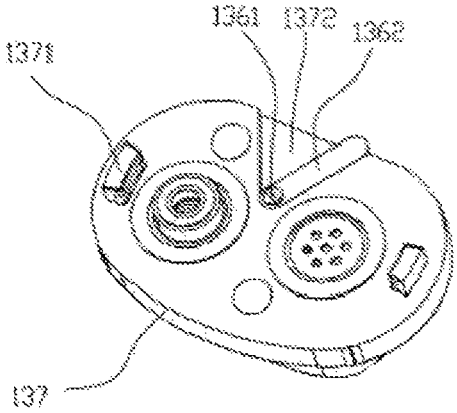
FIG. 6 is a structural diagram of another control manner of the regulating switch.

In other embodiments, as shown in FIG. 6, the control mode for the regulating switch 136 can also be as follows. One end on which the groove 1361 is defined extends a control rod 1362, which extends out of the mouthpiece 120 for a user to regulate. Moreover, the connecting piece 137 has provided thereon a preset track space 1372 configured for accommodating the control rod 1362.

In this embodiment, the aerosol inhaling device 100 includes the first chamber 131 and the second chamber 132, the first chamber 131 and the second chamber 132 can heat up independently and can be in communication with the first branch 134 and the second branch 135 respectively, and the second branch 135 has provided therein the regulating switch 136 configured for regulating a rate of the airflow passing through the second branch, thus, the air outlet volume of the second chamber 132 can be regulated through the regulating switch 136, thereby the aerosol volume converged in the air outlet passage 133 can be regulated. When the first chamber 131 and the second chamber 132 heat aerosol-generating substances with different flavors, the flavor of the aerosol inhaled by a user can be regulated according to the preference of the user.

The above content illustrates the principle and implementations of the present disclosure using exemplary embodiments. It is understandable that the above implementation is merely to help understand the present disclosure, and cannot be understood as a restriction to the present disclosure. For the ordinary skill in this field, any minor improvements or equivalent substitutions made to the structure shape or construction of the present disclosure according to the idea of the present disclosure are intended to fall within the scope of protection of the present disclosure.

What is claimed is:

1. An aerosol generator, comprising two chambers, an air outlet passage, a first branch and a second branch, the two chambers being configured for generating an aerosol and each of the two chambers defining an air inlet and an air outlet, the first branch being in communication with one of the two air outlets, the second branch being in communication with the other of the two air outlets, airflows in the first and second branches being converged in the air outlet passage before being expelled, at least one of the first and second branches being provided with a regulating switch, the regulating switch being configured for regulating a rate of an airflow passing through the second branch, and the regulating switch being capable of rotating around a shaft under an external force to control an airflow passing through the second branch.

2. The aerosol generator according to claim 1, wherein at least one of the two air outlets has an air filtering element provided thereon.

3. The aerosol generator according to claim 1, wherein the air outlet passage has a radiating fin provided on an outer wall thereof.

4. The aerosol generator according to claim 1, wherein at least one of the two chambers adopts an electromagnetic induction heating manner.

5. The aerosol generator according to claim 1, wherein at least one of the two chambers adopts a scheme of heating a solid aerosol-generating substance to generate an aerosol.

6. The aerosol generator according to claim 1, wherein at least one of the two chambers adopts a scheme of heating a tobacco liquid to generate an aerosol.

7. The aerosol generator according to claim 1, wherein the regulating switch has one end extended out of a housing of the aerosol generator for a user to regulate.

8. The aerosol generator according to claim 1, wherein the aerosol generator further comprises a detachable mouthpiece, in which the air outlet passage, the regulating switch, the first branch and the second branch are disposed; and wherein, after the mouthpiece is detached, the two chambers are exposed for refill of an aerosol-generating substance, and one end of the regulating switch is exposed for a user to regulate the rotation of the regulating switch.

9. The aerosol generator according to claim 1, wherein the air outlet passage further comprises a mixing chamber, the mixing chamber being defined where the air outlet passage is in connection with the first branch and the second branch.

10. An aerosol inhaling device, comprising an aerosol generator and a power supply, the power supply being configured for supplying power to the aerosol generator, wherein the aerosol generator is the aerosol generator according to claim 1.

* * * * *